United States Patent [19]

Pratzer

[11] Patent Number: 4,936,640

[45] Date of Patent: Jun. 26, 1990

[54] ANTI-TIP MECHANISM AND METHOD FOR PROVIDING ANTI-TIP DEVICE

[75] Inventor: Isy S. Pratzer, Willowdale, Canada

[73] Assignee: Pundra Industries Ltd., Toronto, Canada

[21] Appl. No.: 384,792

[22] Filed: Jul. 25, 1989

[30] Foreign Application Priority Data

Jul. 26, 1988 [CA] Canada ..... 573096

[51] Int. Cl.[5] ..... E05C 7/06

[52] U.S. Cl. ..... 312/221

[58] Field of Search ..... 312/216–221

[56] References Cited

U.S. PATENT DOCUMENTS

| | | | |
|---|---|---|---|
| 3,588,558 | 6/1975 | Himsl | 312/221 X |
| 3,589,783 | 6/1971 | Studinski | 312/221 X |
| 4,429,930 | 2/1984 | Blouin | 312/221 X |
| 4,480,883 | 11/1984 | Young | 312/221 X |
| 4,637,667 | 1/1987 | Reid et al. | 312/221 |
| 4,768,844 | 9/1988 | Ludwig | 312/221 |
| 4,820,002 | 4/1989 | Lechner et al. | 312/221 |

*Primary Examiner*—Joseph Falk

*Attorney, Agent, or Firm*—Blake, Cassels & Graydon

[57] ABSTRACT

A latching mechanism is provided for use with a cabinet having a number of drawers in stacked relation, to permit the opening of only one drawer at a time. The mechanism is suited for retroactive fitting to existing cabinets, and for original equipment manufacture. The mechanism components are mounted on the drawer slide, the active components being secured by way of a bracket to the stationary channel member of the slide, and an actuating pin for cooperation therewith secured to a movable drawer slide. A lock and locking systems components also may be provided. A method of constructing an anti-tip locking mechanism is also provided.

19 Claims, 4 Drawing Sheets

FIG.5.
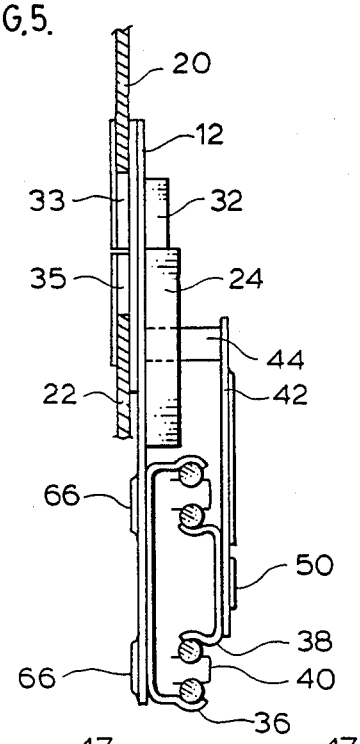
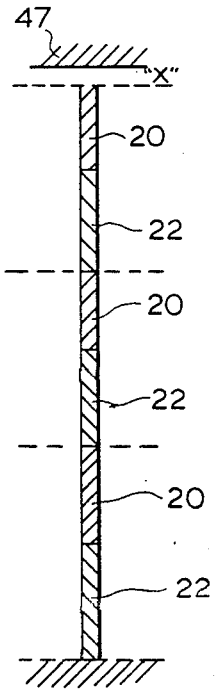
FIG.6A.
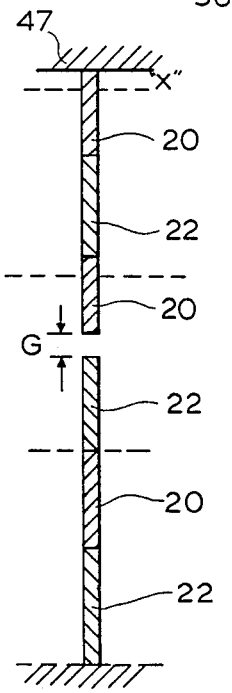
FIG.6B.
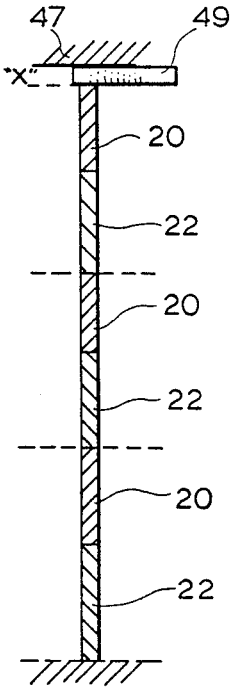
FIG.6C.

ANTI-TIP MECHANISM AND METHOD FOR PROVIDING ANTI-TIP DEVICE

FIELD OF THE INVENTION

This invention is directed to a safety mechanism for use with cabinets and the like having slideable drawers, and in particular to an anti-tip device, for use with such cabinets, and to its method of use.

BACKGROUND OF THE INVENTION

Sliding drawer cabinets having a plurality of drawers in mutually stacked relations are in widespread use. While many such cabinets are provided with anti-tip arrangements, to permit opening of only one drawer at a time as a precaution against tipping of the cabinet, there exist many cabinets that are not thus equipped.

Cabinets equipped with anti-tip devices generally require special provision of an internal guide channel within the interior structure of the cabinet, for installation therein of an arrangement of motion-transmitting slide bars. Furthermore, the flexible construction of pressed light sheet metal cabinets does not lend itself to precise component location.

Satisfactory operation of anti-tip mechanisms generally require great Precision in the installation of the anti-tip interactive components secured to the cabinet, and of the related actuating pins carried by the cabinet drawers, to make precise contact with the cabinet-mounted comPonents, in the opening or immobilization of respective ones of the drawers.

SUMMARY OF THE INVENTION

The present invention provides a mechanism for use with multi-drawer cabinets, the mechanism comprising a numbers of sets of components, one set for each drawer, attachable to the respective drawer slide, substantially independently of the cabinet structure. The mechanism may be provided in kit form for installation and use.

The presently disclosed kit may be used as a retrofit for existing cabinets, or for new construction, or for repairs, being interchangeable. It is to be understood that "cabinets" include a wide variety of devices having multiple storage compartments. Office furniture including desks, credenzas, bookshelves and stands and other kinds of furniture are possible applications. Filing cabinets are also included.

The kit components may be attached by way of brackets to existing drawer slides. However, it is preferred that drawer slide be included as a component of each set of the kit, including therewith provision for attachment of the relevant other components of the kit thereto. However, the means of attachment of the kit components to the drawer slides is not critical.

It will be understood that a drawer slide, generally of the progressive, three component ball bearing type comprises a stiff, substantially precision engineered product of markedly greater strength, rigidity and precision than the pressed steel components that comprise the cabinet and drawers. Thus, the drawer slide provides a superior mount, both for the mounting bracket and its associated slide bar components, and for the actuating pin by way of its mounting bracket. The present invention thus provides a modular kit, for use in installed relation within a cabinet having at least one inwardly and outwardly slidable drawer, supported by a drawer slide having a stationary channel member and a movable slide member carried by the channel member, the kit comprising a component set having: support means securable to said channel member; slide bar assembly means slidably securable to the support means for substantially vertical displacement when installed; the slide bar assembly means including an upper bar assembly and a lower bar assembly adapted for installation in aligned relation; cam means carried by one said bar assembly operable between first and second positions; in the first position, said cam means being adapted to relatively displace said slide bar assemblies thereby forming a gap adjacent one end of said slide bar assemblies upon closing said corresponding drawer, in the second position, said cam means being adapted to relatively displace said slide bar assemblies thereby substantially filling said gap upon opening said drawer; means for limiting the maximum relative displacement of said slide bar assemblies to a distance substantially equal to said gap; and actuating means securable to the movable slide member and adapted to engage said cam means in said first and second positions, such that in said first position, if said slide bar assemblies are obstructed from filling said gap, opening of said drawer is prevented.

The invention also provides a latching mechanism for a series of aligned storage compartments within a cabinet, each compartment being mounted on drawer support slides in slidable engagement with drawer slide stationary members supported by said cabinet, said mechanism comprising: a plurality of substantially vertically aligned slide bar assemblies each having slide bars connected to a corresponding drawer slide stationary member and slidable between opposed ends, one of the ends, with the compartments in a closed position, defining a gap between said end of the aligned slide bar assemblies and the cabinet; and an engagement means corresponding to each compartment, each engagement means being adapted to be carried by a corresponding drawer slide and adapted to bear on one of the slide bars, each engagement means being movable when the slide bars are slidable in the direction of the gap and being adapted to prevent opening of the corresponding compartment when movement of the engagement means is prevented, so that, while the slide bars are slidable in the direction of the gap, opening of a compartment causes the corresponding engagement means to move, thereby causing at least one of the slide bars to slide a distance substantially equal to the gap and to slide in the direction of the gap, and also causes the said corresponding engagement means to bridge the gap, thereby preventing sliding of the other slide bars and movement of the other engagement means, the engagement means when prevented from movement obstruct the opening of the other compartments, so that, when any compartment is open, the opening of other compartments is prevented.

In one embodiment, the kit further includes a drawer slide, for installation within the cabinet, having means to facilitate attachment of other components of the device thereto at a predetermined longitudinal location along the slide, to facilitate vertical registry of one set of slide bars with the slide bars of vertically adjacent sets of slide bars.

In a further embodiment the device components include biasing means, preferably a return spring for attachment to one of the slide bars to urge the slide bars together and away from the gap.

A yet further embodiment may incorporate lock means installable in the cabinet and operable to immobilize the aggregate slide bar assembly of a series of kits or latching mechanism against individual separation between top and bottom bars of each set by actuation of the respective cam means.

The device in accordance with the present invention may incorporate therewith a slide bar stop means, for attachment to a Portion of a cabinet in aligned relation with an adjacent bar of a plurality of slide bar assemblies thereby forming a gap between said stop means and the adjacent bar, to permit stacking of the bars in mutual inhibiting relation by operation of one of the drawers thereby causing the adjacent bar to fill the gap, or by the introduction of locking means to occupy the gap otherwise present between the stop means and the adjacent bar member with all the drawers closed. The kit may in this fashion be used to provide a combined anti-tip mechanism and locking means for a multiple drawer cabinet.

Alternatively, inner surfaces of the cabinet may provide the required space limitation of the stacked bars for their required operation.

It will be understood that the term "drawer" encompasses the usual box-like receptacle and other storage compartments, of differing proportions and construction, suited for use with the present invention. A drawer component, and cabinet may be made of any one or more of a wide variety of substantially rigid materials, including, metals, wood or wood laminates, plastics and many others.

The present invention further provides a method of providing an anti-tip capability to a cabinet having a plurablity of drawers mounted for free, substantially unrestricted opening and closing motion including the steps of: securing in aligned relation along one side of said cabinet a plurality of slide bar assemblies to drawer slide stationary members at a predetermined location therealong; attaching movable cam means in abutting relation with a slide bar assembly for each of the related drawer slides; securing actuating means to a drawer support slide bar for each of the related drawer slides, in predetermined registry with said cam means of the slide bar assemblies, to control withdrawal movement of the actuating means and drawer support slide; and, providing limit means to limit expansion of the slide bar assemblies to a predetermined amount sufficient only to permit actuation of a single cam means by the related actuating means, for withdrawal of the associated selected drawer.

BRIEF DESCRIPTION OF THE DRAWINGS

Certain embodiments of the present invention are described, for purposes of illustration and without being limited thereto, reference being made to the accompanying drawings, wherein;

FIG. 4A is a side elevation of another embodiment of the present invention.

FIG. 5 is an end elevation of the FIG. 4 assembly;

FIG. 6 comprises a schematic showing of the slide bar arrangements of a 3-drawer assembly in sequential conditions:

FIG. 6 A, as with all drawers closed;

FIG. 6 B, as with the middle drawer open, and upper and lower drawers immobilized, FIG. 6 C, as with locking means inserted to preclude operation of all three drawers.

DETAILED DESCRIPTION OF THE INVENTION

Figure 1:
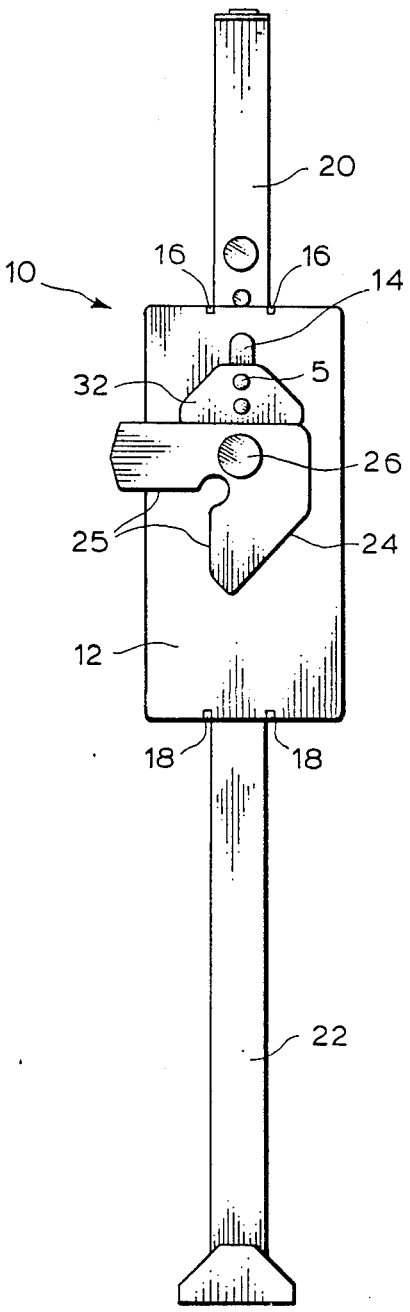
FIG. 1 is a side elevational view of the support bracket, slide bar assembly and cam means for a one-drawer kit set, with the cam means in a drawer-closed condition.
Figure 2:
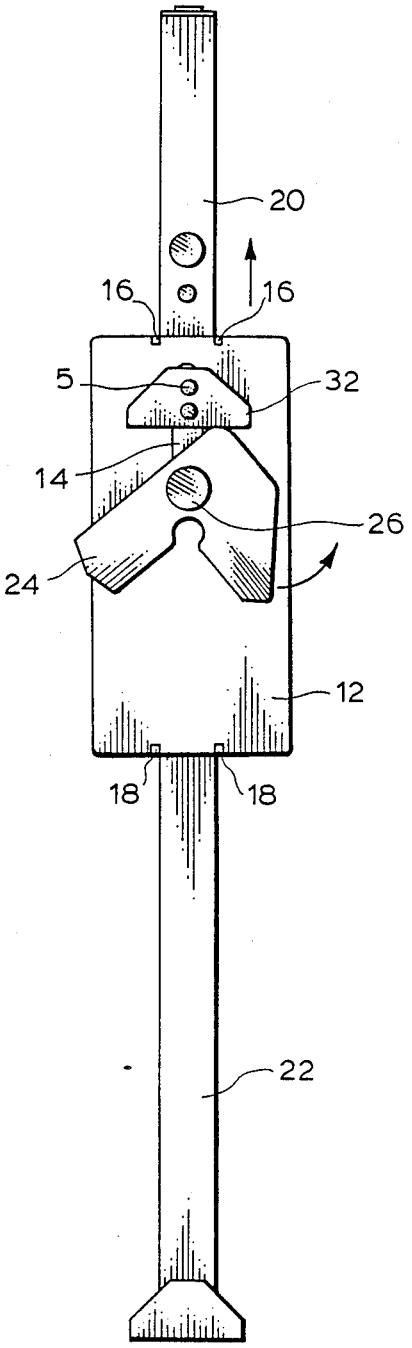
FIG. 2 is an assembly view similar to FIG. 1, having the cam means in a "partly opened" condition.
Figure 3:
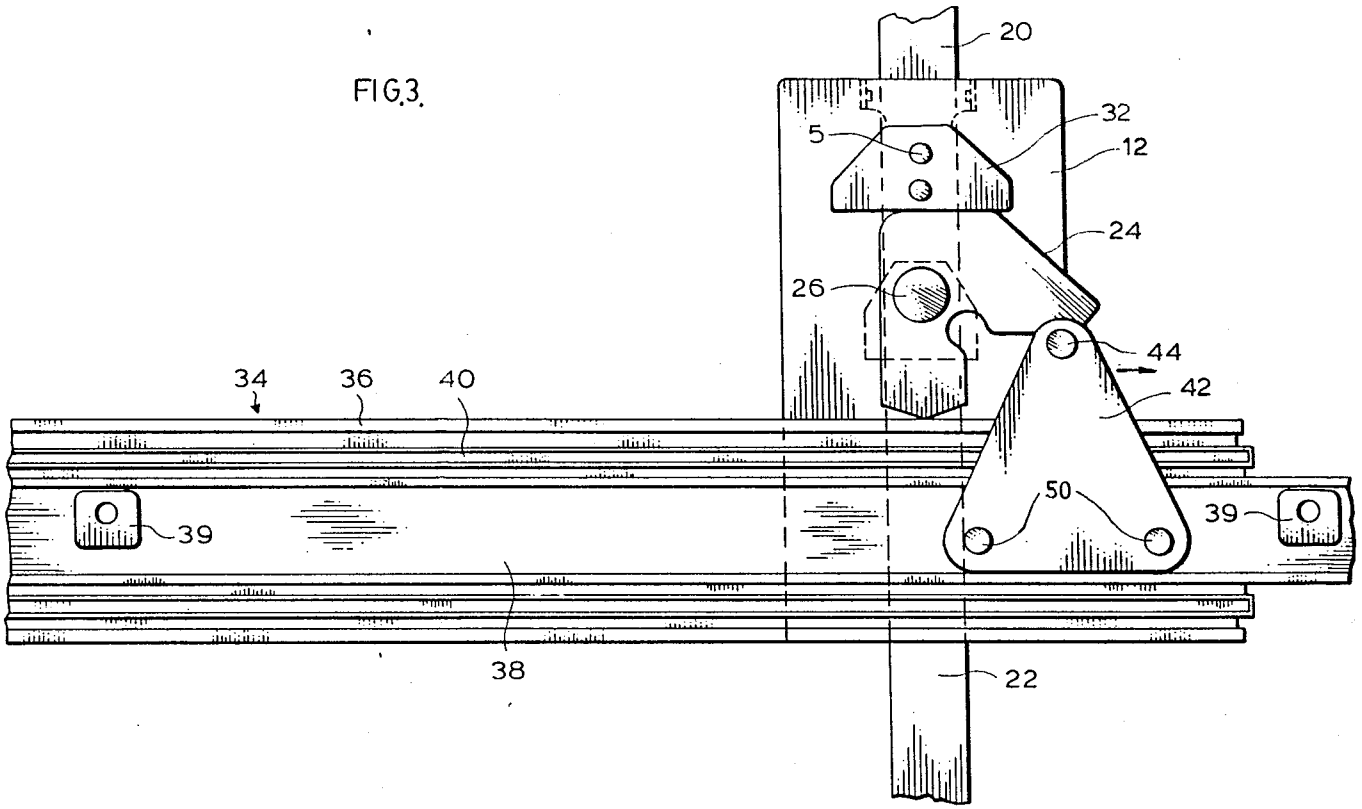
FIG. 3 an anterior view of the FIG. 2 assembly, in assembled relation with a drawer slide, including the bracket mounted actuating pin.

Referring to FIGS. 1, 2, and 3 a first embodiment assembly 10 of a single set of the modular kit comprises bracket 12 having a channel 14. Upper slide bar 20 and lower slide bar 22 may travel along the axis of channel 14. Guide tabs 16, 18 are provided along or adjacent channel 14 to limit lateral displacement of upper slide bar 20 and lower slide bar 22.

In this embodiment, cam means 24 are pivotally secured by pivot pin 26 to the lower slide bar 22, having the bracket 12 located between slide bar 22 and cam means 24, with the pivot pin 26 slidably located in channel 14. Accordingly the cam means 24 is able to undergo rotational or translational movement provided no external restrictions exist. The pin 26 serves also to secure slide bar 22 to the cam means 24 through the channel 14 of bracket 12.

The upper slide bar 20 has a cam follower portion 32 secured thereto by one or more pins or rivets slidably extending through the channel for vertical sliding movement in channel 14 as it follows the bearing surface of cam means 24. The edge portions of bracket 12 which define the channel 14 extend in sandwiched relation between the upper slide bar 20 and the cam follower portion 32, to retain the cam follower portion in aligned registry with the actuating upper edges of cam means 24. The cam follower portion may be secured to the upper slide bar by a pin or rivet 5. Pin 5 extends through channel 14 thereby permitting displacement of upper bar 20 along the channel axis. It is readily understood that the terminal ends of channel 14 define the extent that the lower slide bar 22, and in turn, slide bar 20 may be vertically displaced relative to the bracket. It is also apparent that by carefully selecting the relative length of the channel 14 to be substantially equal to the distance displaced by the upper and lower slide bars upon opening of the corresponding drawer, a feature is thereby provided to limit the total displacement of the slide bars in that assembly, as well as the displacement of like slide bars present in other assemblies installed in combination therewith. Where a cam has been displaced vertically due to the rotation of some other cam, it can be appreciated that no further rotation or displacement will be allowed until the rotated cam is returned to the "closed" position. Alternately, it is possible to select channels of greater length if other stop means are provided to ensure that when installed in combination in aligned abutting relation, said slide bar assemblies will be permitted to separate a distance sufficient only to allow one corresponding drawer to open. When a series of slide bar assemblies have been combined to cooperate with a corresponding number of drawers, the distance to be bridged by a cam upon rotation from the closed position to the open position will be substantially equal to the displacement or separation of the bars. Similarly, when stacked in vertically aligned abutting relation, the distal moving end of combined slide bars will also be displaced an equivalent distance upon rotation of one cam. The space located at such distal end shall be referred to as a "gap". In the disclosed embodiment, the lower slide bar, cam means, upper slide bar and cam, follower means may be upwardly displaced along the channel by a vertically activated slide bar acting from below even though no rotation of the corresponding cam has been effected, provided no restrictive means have been activated to prevent such displacement. The lower terminal end of channel 14 defines the position of the sliding bars in the assembly when the corresponding drawer is in the closed position. The sliding bars in a first assembly will be upwardly displaced relative to that position upon opening of the corresponding drawer, in the first assembly, or upon opening of a drawer in an aligned assembly located below the first assembly.

Figure 4:
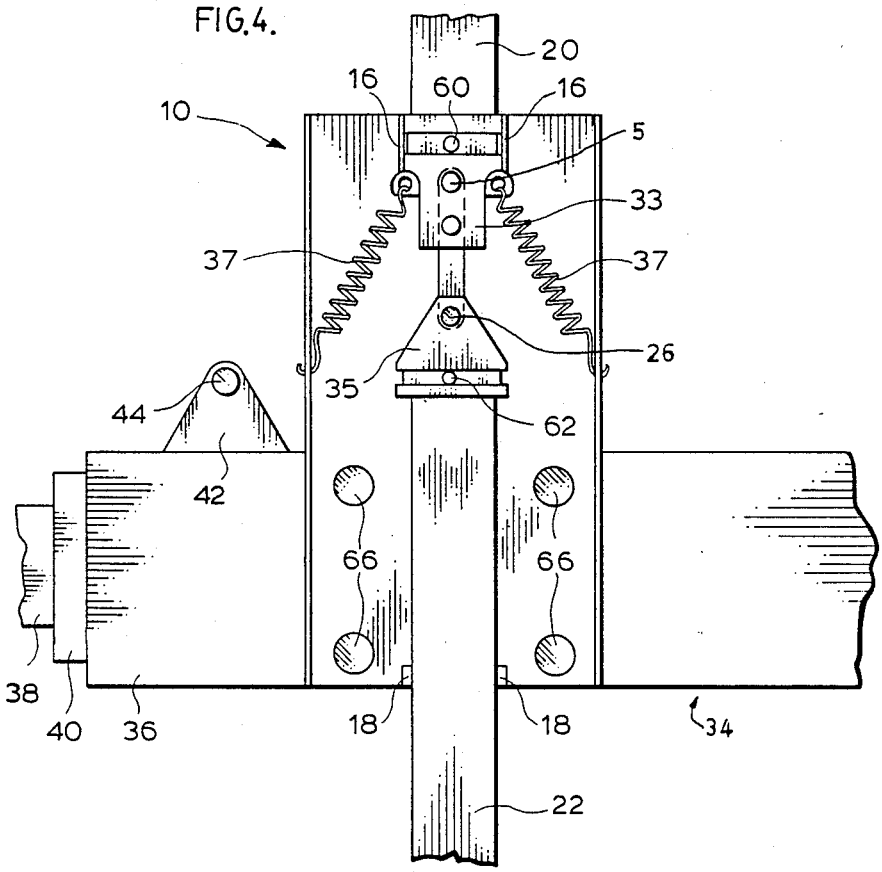
FIG. 4 is a side elevation of the FIG. 2 illustration, in assembled relation with a drawer slide, including the bracket mounted actuating pin.

In a preferred embodiment shown in FIG. 4, sliding bars 20 and 22 are secured to retainers 33 and 35 by means of screws or rivets 60 and 62 respectively. Other securement means may be employed which permit for efficient assembly of the bars to the other kit components. Although it is not essential to employ detachable bar components, it is preferable to do so to provide space saving advantages during shipping prior to installation. Similarly, where the bars are detachable, a wider range of applications may be provided for in each kit. Bars of differing lengths may be secured in each assembly, depending upon the distance to be spanned between adjacent abutting assemblies. Suitable lengths should be selected to ensure that adjacent slide bar assemblies are capable of abutting contact when installed for operation. In those applications where a kit will be used as a latching mechanism for individual securement of one drawer, the slide bar length will usually be selected to be sufficient to act in cooperation with a locking bar or plunger. The length will be selected such that in the closed position, said locking bar will abut against a slide bar so as to prevent opening of the corresponding drawer.

Tension springs 37 are connected to the support bracket and retainer 33 in order to bias upper bar 20 to the "closed" position. It is understood that in most applications where two or more kits are used to form a latching mechanism, only the uppermost assembly of a series of abutting assemblies requires springs in order to provide this biasing action for all aligned assemblies. For example, upon opening of the lowermost drawer, the bar 20 of such assembly would be displaced upwardly thereby engaging and displacing the adjacent abutting slide bar along with the bars of each of the assemblies located above. As the support brackets in each assembly are to be fixed against vertical displacement, and said slide bars in the closed position are all in abutting contact with adjacent slide bars, the springs in the uppermost assembly would be placed under load upon opening any such drawer.

Referring to FIGS. 3, 4 and 5 the assembly 10 is shown in secured relation with a drawer slide assembly 34. The illustrated drawer slide assembly 34, of the progressive 3-channel type comprises a stationary slide channel member 36, a drawer support slide 38 having clips 39 to which one side of a drawer (not shown) is secured. An intermediate movable slide 40 connects movable slide 38 with slide channel member 36, for full extension of drawer slide 38. SupPort bracket 12 is secured to member 36 by means of pins or rivets 66 or other suitable means.

Each kit is provided with an actuating pin 44 carried on a mounting bracket 42. Together, each actuating pin and its corresponding cam means, cooperate to provide an engagement means to prevent opening of the corresponding drawer if the corresponding upper and lower slide bars have been restricted against separation. If no such restriction has been presented, the cam means and pin will engage upon withdrawl of the drawer, causing the sliding bars to separate thereby filling the gap.

A bracket 42 secured to drawer slide 38 carries actuating pin 44 in laterally projecting relation to engage the surfaces 25 of cam means 24. The bracket may be secured to the slide in a number of ways known in the art, including, by means of rivets, screws, bolts, or welding. Pins or rivets 50 are shown in the present embodiment. The selected securement means will depend upon a number of factors including which tools are available or most desirable to the person installing the kit for operation.

In a combined set of aligned assemblies, the sliding bars in a first assembly will be upwardly displaced relative to the closed position upon opening of the corresponding drawer. This will occur whether a drawer corresponding to the first assembly or a lower assembly is opened.

The stationary slide channel member 36 is provided on the reverse face thereof with struck-out clip portions (not shown) to provide precise registry and secure attachment of channel member 36 with the structure of a cabinet, which does not form a part of the present invention.

FIG. 4A shows a more preferred embodiment of the present invention. A mounting bracket 12' is secured to drawer slide bar 36' by means of pins, rivets or bolts 66'. Alternate securement means may be used. Bracket 12' defines a channel 14', one end of the channel terminating intermediate the top and bottom of the bracket. The other end of the channel extends outwardly to the outer edge of the top of the bracket to define a mouth or entrance to the channel. A retainer bar or other suitable means (not shown) may be secured adjacent the entrance to the channel to provide added security against misalignment or escape of members normally operating with the channel. Lower bar 22', situated on one side of bracket 12' is secured to bottom bracket 35' on the other side of bracket 12' by means of lower bracket pin 62'. Lower bracket pin 62' travels within channel 14' upon upward displacement of the lower bar 22'. A rotatable cam 24' is secured to a turning fork 24'' by means of intermediately located rigid pin 26'. The cam 24' is carried on the bottom bracket, but the cam is not connected or otherwise secured to the lower bar assembly. It can be readily understood that each of the bar assemblies and the cam means including the cam and fork assembly may be slidably inserted into channel 14' when assembling the mechanism. Cam 24' is positioned on the same side of bracket 12 as bottom bracket 35' and upper bracket 33'. Cam surface 70 bears against the lower surface of upper bracket 33'. Similarly, cam surface 71 bears against the upper surface of the lower bracket 35'. Brackets 33', 35' and cam 24' on one side, with sliding bars 20', 22' and turning fork 24'' on the other side effectively sandwich mounting bracket 12' between them. It is understood that it is possible to mount the cam and turning fork on one side of the mounting bracket provided suitable means are included to permit proper operation of the cam means along the channel. Upper bracket 33' is secured to upper sliding bar 20' by means of upper bracket pin 5'.

When a drawer is opened, the corresponding actuating pin 80 engages turning fork 24", rotating the fork to the open position. At the same time, cam 24' is rotated to the open position, causing surface 27' to bear against the lower surface of the upper bracket 33' causing the upper bracket and in turn, the upper bar to be displaced upwardly.

Referring to FIG. 6, a stacked series of slide bars for a three drawer arrangement is shown schematically, having the upper slide bars 20 and lower slide bars 22 in axially stacked relation. In fact, the stack effective height includes those contact portions, between respective cam means 24 and cam followers 32. However, those portions of stack height are represented pictorially by the junctures of upper slide bars 20 with lower slide bars 22, for each of the three illustrated kit sets. In this embodiment, limiting means or a fixed stop member 47 secured to the cabinet limits upward slide bar displacement. A stop member which is secured to or integral with the support bracket of the topmost sliding bar assembly maY also be Provided. Such a stop member could be used to restrict the topmost assembly and all assemblies below against upward displacement which could permit more than one drawer to be opened. In the preferred embodiment, the channel 14 in each assembly is of sufficient length to permit one way vertical displacement equivalent to the opening of one drawer only. The length of each channel in the preferred embodiment is restricted to prevent the opening of more than one drawer. It is understood that the channel may be of greater length provided suitable stop means are included to prevent excessive travel or displacement.

Referring to FIG. 6 A, with each of the related drawers in a closed position and the cam means 24 undisturbed, bar stack clearance or gap "x" is available. As shown in FIG. 6 B, with the middle drawer withdrawn and the cam means 24 displaced to generate the clearance "G" between upper and lower slide bars, the gap "x" is effectively taken up. In this condition the middle drawer is free to slide in and out whereas the upper and lower drawers are locked closed.

In FIG. 6C, with all of the drawers closed, the introduction of locking bar 4C takes up the gap "X" sufficiently to preclude operations of any of the cam means 24, thus locking all three drawers.

In order to use the presently disclosed kits 10, in the case where the original drawer slide assemblies are utilized, with the drawers removed from the cabinet the drawer slide assemblies 34 are removed from one side of the cabinet. The drawer slide assemblies 34 may be through-drilled, in the case of stationary channel member 36 and drawer support slide 38, generally without further disassembly, using positioning templates or equivalent, to receive screws (not shown) for attachment of brackets 12 and 42, respectively, thereto. Alternate securement means may be used.

With brackets 12 and 42 in place the upper slide bars 20 are assembled to the respective assemblies 10, by insertion in channel 14 of bracket 12 and the slide assemblies 34, carrying the kit components secured thereto are then reinstalled within the cabinet. As will be understood by those skilled in the art, where the cam and turning fork are carried by but are not attached to a sliding bar assembly, the cam and fork assembly may be inserted into the channel such that the cam will abut with the bar assemblies.

Meanwhile, the cabinet, when necessary, has a stop member 47 installed.

In cases where a lock is to be installed, the face of the cabinet is appropriately drilled to receive the lock set (not shown), for the insertion of lock bar 49, of which only a portion is shown, which is provided with a guide (not shown) adjacent the remote end seen in FIG. 6 C. The lock bar is positioned such that upon locking the cabinet, the lock bar fills the gap "X" thereby preventing all drawers from opening. In other embodiments, a biased locking bar may be Provided which permits the lock bar to be activated even if one drawer is open. In such a case, the lock bar may be biased by spring means such that, upon closure of the one open drawer, the lock bar would enter into the gap thereby locking all drawers against opening.

Reinstatement of the drawers completes the conversion, and after testing and any final adjustments, the cabinet is returned to service.

Where conversion of a cabinet utilizes replacement drawer slide assemblies 34, the original slide assemblies on the appropriate side of the cabinet are removed and the replacement slide assemblies 34, having the brackets 12 assembled therewith, together with rods 20, 22 and cam means 24, are installed within one side of the cabinet. The rest of the process is as detailed.

It will be evident that the subject kit may be used as a locking arrangement on a single drawer cabinet.

Another embodiment is contemplated whereby a drawer slide assembly is provided with said kit components secured thereto. Detachable slide bars may be used where size considerations are important for shipping or handling purposes.

A further contemplated embodiment envisages a plurality of cabinets in mutually superposed relation, wherein the cabinets may be out of vertical registry, in a front to back sense. The installed anti-tip device is located on a common axis therethrough.

It will be understood to those skilled in the art that embodiments of the invention may be modified, and that such useful embodiments and modifications will be within the scope of the following claims.

I claim:

1. A latching mechanism for a plurality of vertically stacked drawers within a cabinet, the drawers being reciprocally slidable along a drawer path by sliding engagement of a drawer slide on a track secured to the cabinet, the latching mechanism comprising vertically slidable slide bars adapted to be secured to said track to slide between said track and a cabinet wall in vertically aligned relationship, and blocking means for each drawer associated with the slide bars for blocking withdrawal from the cabinet of the respective drawer in a one of a number of configurations of the slide bars corresponding to a condition of the cabinet in which one drawer is withdrawn, and for allowing withdrawal from the cabinet of a drawer in a second configuration of the slide bars corresponding to a condition of the cabinet in which all drawers are closed.

2. A latching mechanism as claimed in claim 1, in which the slide bars comprise a pair of aligned slide members for each drawer, the blocking means comprising a rotatable cam carried by one of the pair of members and located to project into said path, and the other member of which carries a cam follower located to bear on the cam for relative axial displacement of the members on rotation of the cam; and in which a cam actuator is provided for connection to the drawer slide to move in the path, the cam actuator being adapted to bias the cam for rotation in a drawer withdrawing direction and in a drawer closing direction according to the direction of reciprocal sliding of the drawer; and in which a support is provided for each pair of slide members, the support being adapted for securement to the track and having a guide slot engageable with guide means of said one member and guide means of said other member for guiding sliding thereof.

3. A mechanism as claimed in claim 2 in which the cam includes a bearing surface for the cam follower, the distance of which surface from the axle increases for rotation of the cam in the drawer direction.

4. A mechanism as claimed in claim 3, in which said one member is to be located as the lower member of the pair of vertically aligned members.

5. A mechanism as claimed in claim 3, in which the guide means of said one member comprises the axle which is adapted to extend through the guide slot of the support.

6. A mechanism as claimed in claim 5, in which stop means are provided to limit axial displacement between members of a pair, said stop means comprising closed ends of said guide slot in a support.

7. A latching mechanism as claimed in claim 5, in which the guide means of said other member comprises a pin projecting through the guide slot from said other member and carrying the cam follower on a distal end thereof.

8. A latching mechanism within a cabinet for a series of vertically stacked drawers of the cabinet, each drawer being mounted through drawer slides in slidable engagement with tracks secured to a cabinet wall, the mechanism comprising vertically stacked, vertically slidable slide bars mounted on the tracks to slide between the track and the cabinet wall; blocking means for each drawer associated with the slide bars for blocking withdrawal from the cabinet of the respective drawer in one of a number first configurations of the slide bars corresponding to a condition of the cabinet in which one drawer is withdrawn, and for allowing withdrawal from the cabinet of a drawer in a second configuration of the slide bars corresponding to a condition of the cabinet in which the drawers are closed.

9. A mechanism within a cabinet as claimed in claim 8, which the slide bars comprise a pair of aligned slide members for each drawer, the blocking means comprising a rotatable cam carried by one of the pair of members and located to project into the path, and the other member of which carries a cam follower located to bear on the cam for relative axial displacement of the members on rotation of the cam; and in which a cam actuator is provided for connection to the drawer slide in the path, the cam actuator being adapted to bias the cam for rotation in a drawer withdrawing direction and in a drawer closing direction according to the direction of reciprocal sliding of the drawer; and in which a support is provided for each pair of slide member, the support being adapted for securement to the track and having a guide slot engageable with guide means of said one member and guide means of said other member for guiding sliding thereof.

10. A mechanism within a cabinet as claimed in claim 8, in which the cam includes a bearing surface for the cam follower, the distance of which surface from the axle increases for rotation of the cam in the drawer direction.

11. A mechanism within a cabinet as claimed in claim 10, in which said one member is to be located as the lower member of the pair of vertically aligned members.

12. A mechanism within a cabinet as claimed in claim 10, in which the guide means of said one member comprises the axle which is adapted to extend through the guide slot of the support.

13. A mechanism within a cabinet as claimed in claim 12, in which stop means are provided to limit axial displacement between members of a pair, said stop means comprising closed ends of said guide slot in a support.

14. A mechanism within a cabinet as claimed in claim 13, in which stop means are provided by an upper stop on the cabinet and a lower stop on the cabinet to limit axial displacement of the slide bars.

15. A mechanism as claimed in claim 13, which the upper stop is a top of the cabinet and the lower stop is the base of the cabinet.

16. The mechanism as claimed in claim 9, including biasing means adapted to urge said slide bar members of each pair apart.

17. The mechanism as claimed in claim 16, the biasing means including spring means.

18. The mechanism as claimed in claims 9, in which each support includes retaining means for detachably retaining the members of the respective pair of slide members.

19. The method of providing an anti-tip capability to a cabinet having a plurality of drawers mounted on drawer support slides in slidable engagement with drawer tracks supported by said cabinet, said drawers being mounted for free, substantially unrestricted opening and closing motion, so as to potentially imperil the stability of the cabinet, including the steps of: securing in aligned relation along one side of said cabinet a slide bar assemblies pair of members to drawer tracks for each drawer at a predetermined location therealong; attaching movable cam means in abutting relation between members of each slide bar pair for each of the related drawer slides; securing actuating means to a drawer slide, in predetermined registry with each cam means of said slide bar pairs; assembling the distal ends of adjacent ones of said slide bar assemblies in abutting relation; and providing limit means to limit expansion of said slide bar pairs to a predetermined extent, whereby only one of said cam means is actuable to a position for release of a selected said drawer.

* * * * *